US007527105B2

(12) United States Patent
Hall et al.

(10) Patent No.: US 7,527,105 B2
(45) Date of Patent: May 5, 2009

(54) POWER AND/OR DATA CONNECTION IN A DOWNHOLE COMPONENT

(76) Inventors: David R. Hall, 2185 S. Larsen Pkwy., Provo, UT (US) 84606; Scott Dahlgren, 2185 S. Larsen Pkwy., Provo, UT (US) 84606; Johnathan Marshall, 2185 S. Larsen Pkwy., Provo, UT (US) 84606; Tyson J. Wilde, 2185 S. Larsen Pkwy., Provo, UT (US) 84606

( * ) Notice: Subject to any disclaimer, the term of this patent is extended or adjusted under 35 U.S.C. 154(b) by 302 days.

(21) Appl. No.: 11/559,461

(22) Filed: Nov. 14, 2006

(65) Prior Publication Data

US 2008/0110638 A1 May 15, 2008

(51) Int. Cl.
*E21B 17/02* (2006.01)
*E21B 47/12* (2006.01)

(52) U.S. Cl. ..... 166/380; 166/65.1; 166/242.6; 175/320; 340/855.1

(58) Field of Classification Search ..... 175/320; 166/65.1, 242.1, 242.6, 380; 340/855.1
See application file for complete search history.

(56) References Cited

U.S. PATENT DOCUMENTS 2,301,753 A * 11/1942 Lee ..... 439/191
2,414,719 A 1/1947 Cloud
3,170,137 A * 2/1965 Brandt ..... 340/855.1
3,967,201 A 6/1976 Rorden
4,416,494 A 11/1983 Watkins
4,785,247 A 11/1988 Meador
4,806,928 A 2/1989 Vereruso
6,392,317 B1 5/2002 Hall
6,670,880 B1 12/2003 Hall
6,717,501 B2 4/2004 Hall
6,799,632 B2 10/2004 Hall
6,821,147 B1 11/2004 Hall
6,830,467 B2 12/2004 Hall
6,844,498 B2 1/2005 Hall
6,888,473 B1 5/2005 Hall
6,913,093 B2 7/2005 Hall
6,929,493 B2 8/2005 Hall
6,945,802 B2 9/2005 Hall
6,968,611 B2 11/2005 Hall
7,190,280 B2 * 3/2007 Hall et al. ..... 340/855.1
7,201,240 B2 * 4/2007 Hall et al. ..... 175/320
2004/0104797 A1 6/2004 Hall
2004/0113808 A1 6/2004 Hall
2004/0145492 A1 7/2004 Hall
2004/0150532 A1 8/2004 Hall
2004/0164833 A1 8/2004 Hall
2004/0164838 A1 8/2004 Hall
2004/0216847 A1 11/2004 Hall
2004/0244916 A1 12/2004 Hall
2004/0244964 A1 12/2004 Hall
2004/0246142 A1 12/2004 Hall (Continued)

*Primary Examiner*—Hoang Dang
(74) *Attorney, Agent, or Firm*—Tyson J. Wilde

(57) ABSTRACT

A downhole component of a tool string, having a first and a second end intermediate a tubular body. First and second collars are mounted to the inner surface of the component at the first and second ends respectively. Each collar has an electrical conductor secured to the collar. The first collar has a bearing surface adapted to slide with respect to the inner surface of the component and the second collar is rotationally fixed to the inner surface of the component.

18 Claims, 10 Drawing Sheets

U.S. PATENT DOCUMENTS

| | | | | |
|---|---|---|---|---|
| 2005/0001735 | A1 | 1/2005 | Hall | |
| 2005/0001736 | A1 | 1/2005 | Hall | |
| 2005/0001738 | A1 | 1/2005 | Hall | |
| 2005/0035874 | A1 | 2/2005 | Hall | |
| 2005/0035875 | A1 | 2/2005 | Hall | |
| 2005/0035876 | A1 | 2/2005 | Hall | |
| 2005/0036507 | A1 | 2/2005 | Hall | |
| 2005/0039912 | A1 | 2/2005 | Hall | |
| 2005/0045339 | A1 | 3/2005 | Hall | |
| 2005/0046586 | A1 | 3/2005 | Hall | |
| 2005/0046590 | A1 | 3/2005 | Hall | |
| 2005/0067159 | A1 | 3/2005 | Hall | |
| 2005/0070144 | A1 | 3/2005 | Hall | |
| 2005/0082092 | A1 | 4/2005 | Hall | |
| 2005/0092499 | A1 | 5/2005 | Hall | |
| 2005/0093296 | A1 | 5/2005 | Hall | |
| 2005/0095827 | A1 | 5/2005 | Hall | |
| 2005/0115717 | A1 | 6/2005 | Hall | |
| 2005/0145406 | A1 | 7/2005 | Hall | |
| 2005/0150653 | A1 | 7/2005 | Hall | |
| 2005/0161215 | A1 | 7/2005 | Hall | |
| 2005/0173128 | A1 | 8/2005 | Hall | |
| 2005/0212530 | A1 | 9/2005 | Hall | |
| 2005/0236160 | A1 | 10/2005 | Hall | |
| 2005/0284662 | A1 | 12/2005 | Hall | |
| 2006/0124291 | A1* | 6/2006 | Chau | 166/65.1 |
| 2007/0102197 | A1* | 5/2007 | Rotthaeuser | 175/320 |
| 2007/0137853 | A1* | 6/2007 | Zhang et al. | 166/65.1 |
| 2008/0041575 | A1* | 2/2008 | Clark et al. | 166/65.1 |
| 2008/0047703 | A1* | 2/2008 | Stoesz et al. | 166/65.1 |

* cited by examiner

POWER AND/OR DATA CONNECTION IN A DOWNHOLE COMPONENT

BACKGROUND OF THE INVENTION

The present invention relates to the field of data and/or power transmission. More specifically, it relates to the field of apparatus for transmitting data and/or power through such downhole tool strings.

Downhole tool strings have become increasingly versatile in the last half century. In addition to traditional oil, gas, and geothermic exploration and production purposes, tubular tool strings are often used for what is known as horizontal directional drilling to install underground power lines, communication lines, water lines, sewer lines, and gas lines. This sort of downhole drilling is particularly useful for boring underneath roadways, waterways, populated areas, and environmentally protected areas.

The increased versatility of downhole drilling with tool strings has led to a higher demand for apparatus that are able to transmit a power signal to downhole equipment as well as transmit data between downhole and surface tools. Hence, several different approaches to solving the problem of transmitting an electrical signal across the joints of a tool string have been developed and are known in the art.

U.S. Pat. Nos. 6,670,880; 6,982,384; and 6,929,493 to Hall, all of which are incorporated herein by reference for all that they disclose, teach systems wherein tubular components are inductively coupled at threaded joints in the tool string. Other downhole telemetry systems are disclosed in U.S. Pat. No. 6,688,396 to Floerke et al and U.S. Pat. No. 6,641,434 to Boyle et al, which are also herein incorporated by reference for all that they contain.

Optimally, a system for transmitting data and/or power between surface equipment and downhole tools in a tool string is transparent to the tool string operator or crew, as time delays introduced by a complicated telemetry system may represent a significant amount of money.

BRIEF SUMMARY OF THE INVENTION

In one aspect of the invention, a downhole component of a tool string, having a first and a second end intermediate a tubular body. First and second collars are mounted to the inner surface of the component at the first and second ends respectively. Each collar has an electrical conductor secured to the collar. The first collar has a bearing surface adapted to slide with respect to the inner surface of the component and the second collar is rotationally fixed to the inner surface of the component.

The downhole component may be a drill pipe, drill collar, crossover sub, reamer, jar, hammer, heavy weight pipe, double shouldered pipe, single shouldered pipe, or combinations thereof.

The bearing surface may comprise a polished surface. The bearing surface may comprise alumina, diamond, steel, silicon nitride, cubic boron nitride, ceramics, carbide, titanium, aluminum, chromium, or combinations thereof.

The first collar may comprise a key complimentary to another key formed in the second collar, wherein the first and second keys are adapted to interlock. The second collar may be keyed, glued, brazed, or press fit into the second end. Either collar may be disposed within a recess formed in the inner surface and held in place by tension provided by the electrical conductor. The collar may comprise a plurality of electrical conductors.

The electrical conductor may be secured within one of the keys. The electrical conductor may be in tension between the first and second collars. The electrical conductor may comprise a signal transmission element proximate an end of the collar. The signal transmission element may be spring loaded. The spring load may be generated by a coiled spring, a Belleville spring, a gas spring, a wave spring, an elastomeric material, hoop tension, ramped surfaces, or a combination thereof. The signal transmission element may be an optical element, magnetic element, electrically conductive element, inductive element, or combinations thereof. The signal transmission element may comprise an electrically conductive center and an electrically insulating periphery. The electrical conductor may comprise a venting port proximate the signal transmission element. The electrical conductor may be a coaxial cable, copper wire, triaxial cable, twisted pair of wires, or combinations thereof. The electrical conductor may be secured within a passageway formed in the collar. The electrical conductor may be adapted to rotate within the passageway.

A method for aligning transmission elements while threadingly joining downhole components comprises the steps of providing a first downhole component with a first collar mounted in a first end; the first collar being rotationally fixed to an inner surface of the first downhole component; providing a second downhole component with a second collar mounted in a second end; the second collar comprising a bearing surface adapted to allow the second collar to rotate with respect to an inner surface of the second downhole component; providing a first key of the first collar complimentary to a second key of the second collar; inserting the first end into the second end and rotating them with respect to one another; aligning the collars such that the transmission elements align by catching the key of the first collar with the key of the second collar as the collars rotate with respect to one another; rotating the second collar with respect to the second downhole component by allowing the first and second keys to interlock after the key of the first collar catches the key of the second collar; and bringing the transmission elements into close proximity to each other by continuing to rotate the ends relative to one another until the ends are sufficiently torqued together.

In another aspect of the invention, a downhole component of a tool string, comprising a tubular body intermediate a first and a second end; a collar mounted to the inner surface of the component at one end; an electrical conductor secured to the collar; and the collar comprising a bearing surface adapted to slide with respect to the inner surface of the component.

DETAILED DESCRIPTION OF THE INVENTION AND THE PREFERRED EMBODIMENT

Figure 1:
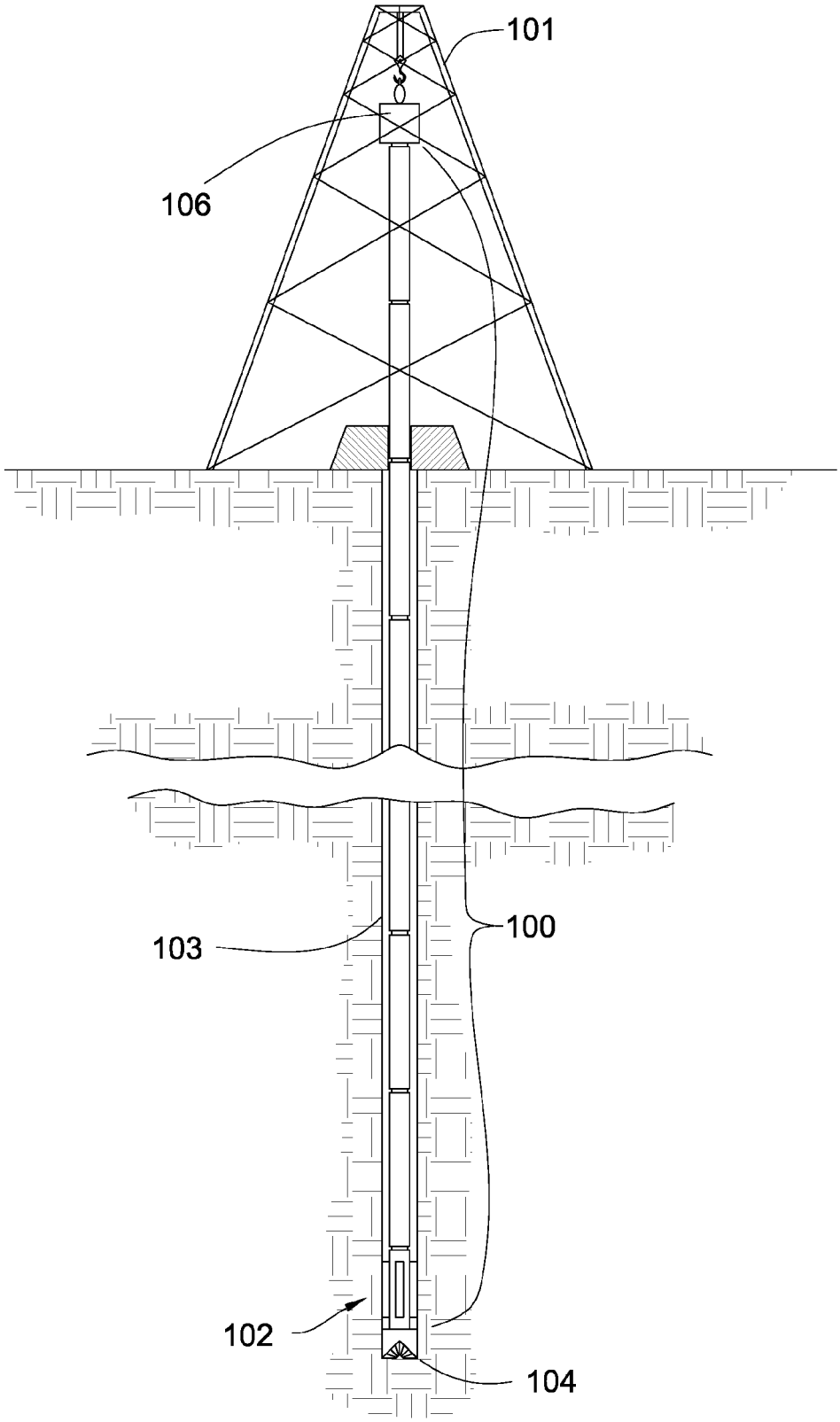
FIG. 1 is a perspective diagram of an embodiment of a drill string suspended in a bore hole.

FIG. 1 is an embodiment of a drill string 100 suspended by a derrick 101. A bottom-hole assembly 102 is located at the bottom of a bore hole 103 and comprises a drill bit 104. As the drill bit 104 rotates downhole the drill string 100 advances farther into the earth. The drill string may penetrate soft or hard formations. The bottom-hole assembly 102 and/or downhole components may comprise data acquisition devices which may gather data. The data may be sent to the surface via a transmission system to a data swivel 106. The transmission system may comprise an electrical path traveling a length or a portion of the length of the drill string. The path may be a plurality of electrical conductors coupled together at threadedly connected ends of consecutive downhole components. The data swivel 106 may send the data to the surface equipment. Further, the surface equipment may send data and/or power to downhole tools and/or the bottom-hole assembly 102.

Figure 2:
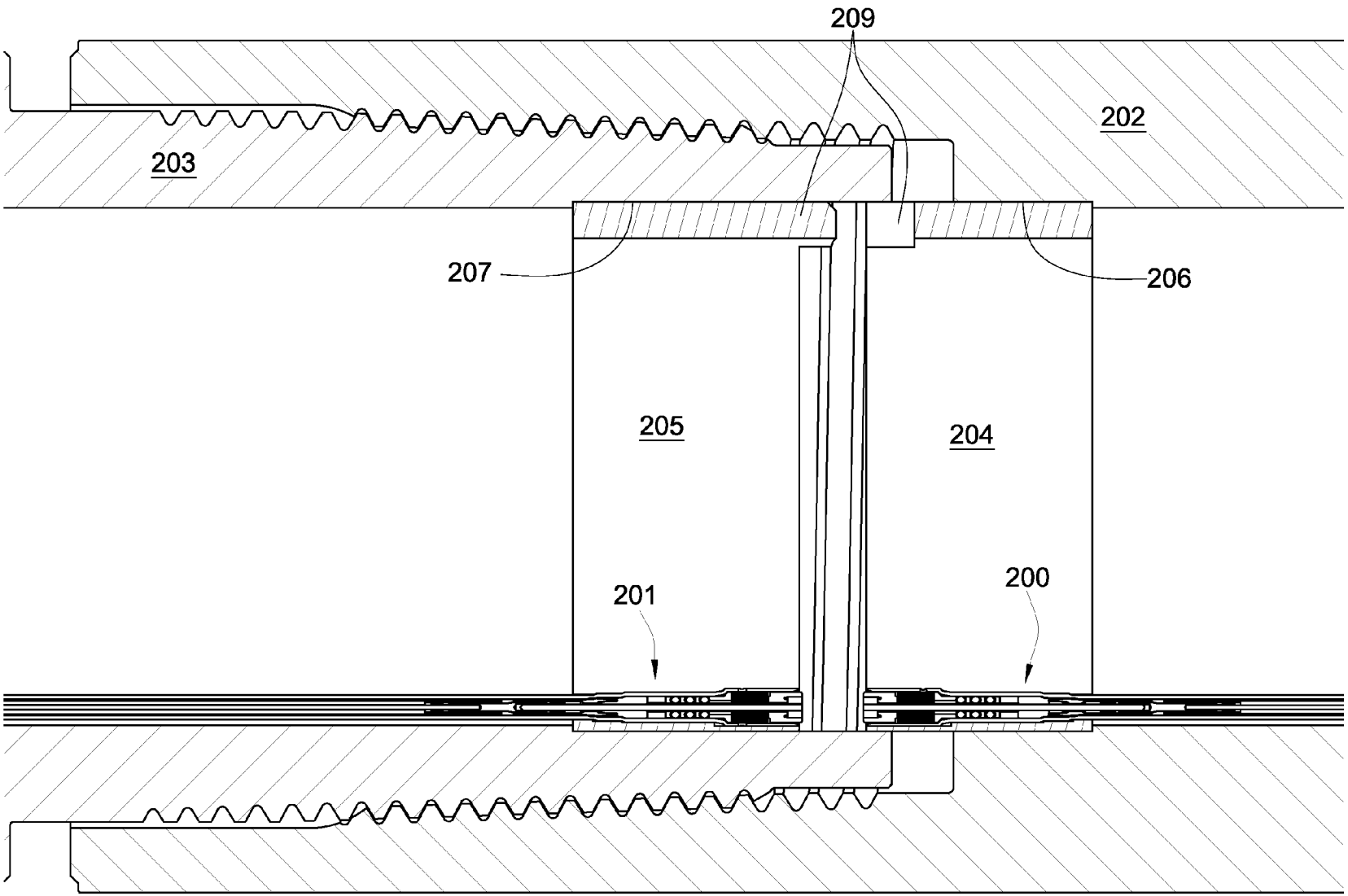
FIG. 2 is a cross-sectional diagram of an embodiment of electrical conductors in two tubular bodies.

Referring to FIG. 2, a first electrical conductor 200 is disposed within a box end 200 of a first component 202 and a second electrical conductor 201 is disposed within a pin end of a second component 203. The two components 202, 203 are threadedly connected. The box end of the first component 202 comprises a first collar 204 wherein the first conductor 200 is secured, and the pin end of the second component 203 comprises a second collar 205 wherein the second conductor 201 is secured. The first and second collars 204, 205 are mounted to an inner surface 206, 207 of the first and second components 202, 203, respectively.

The first collar 204 comprises an outer bearing surface 208 adapted to rotate with respect to the inner surface 206 of the first component 202, while the second collar 205 is rotationally fixed to the inner surface 207 of the second component 203. The bearing surface 208 may comprise alumina, diamond, steel, silicon nitride, cubic boron nitride, ceramics, carbide, titanium, aluminum, chromium, or combinations thereof. The bearing surface 208 may comprise a polished surface, which may allow the first collar 204 to rotate while also providing wear protection for the collar 204. The second collar 205 may be keyed, glued, brazed, or press fit into the pin end of the second component 203 in order to keep it rotationally fixed to the inner surface 207.

Each collar comprises a key 209 complimentary to the other such that the key of the first collar 204 is adapted to interlock with the key of the second collar 205. As the components are being threaded together, the keys will catch each other and interlock. When the keys are interlocked with each other, the collars become rotationally fixed to each other; the first collar rotates with respect to the inner surface of the first component and the second collar 205 remains rotationally fixed with respect to the inner surface 207 of the second component 203. The first collar 204 therefore becomes rotationally fixed with respect to the second component 203 as well. The first and second conductors 200, 201 in the collars line up with each other when the keys are interlocked. As the components continue twisting together, the collars come closer together, causing the conductors to come in contact with each other, establishing an electrical connection.

Figure 3:
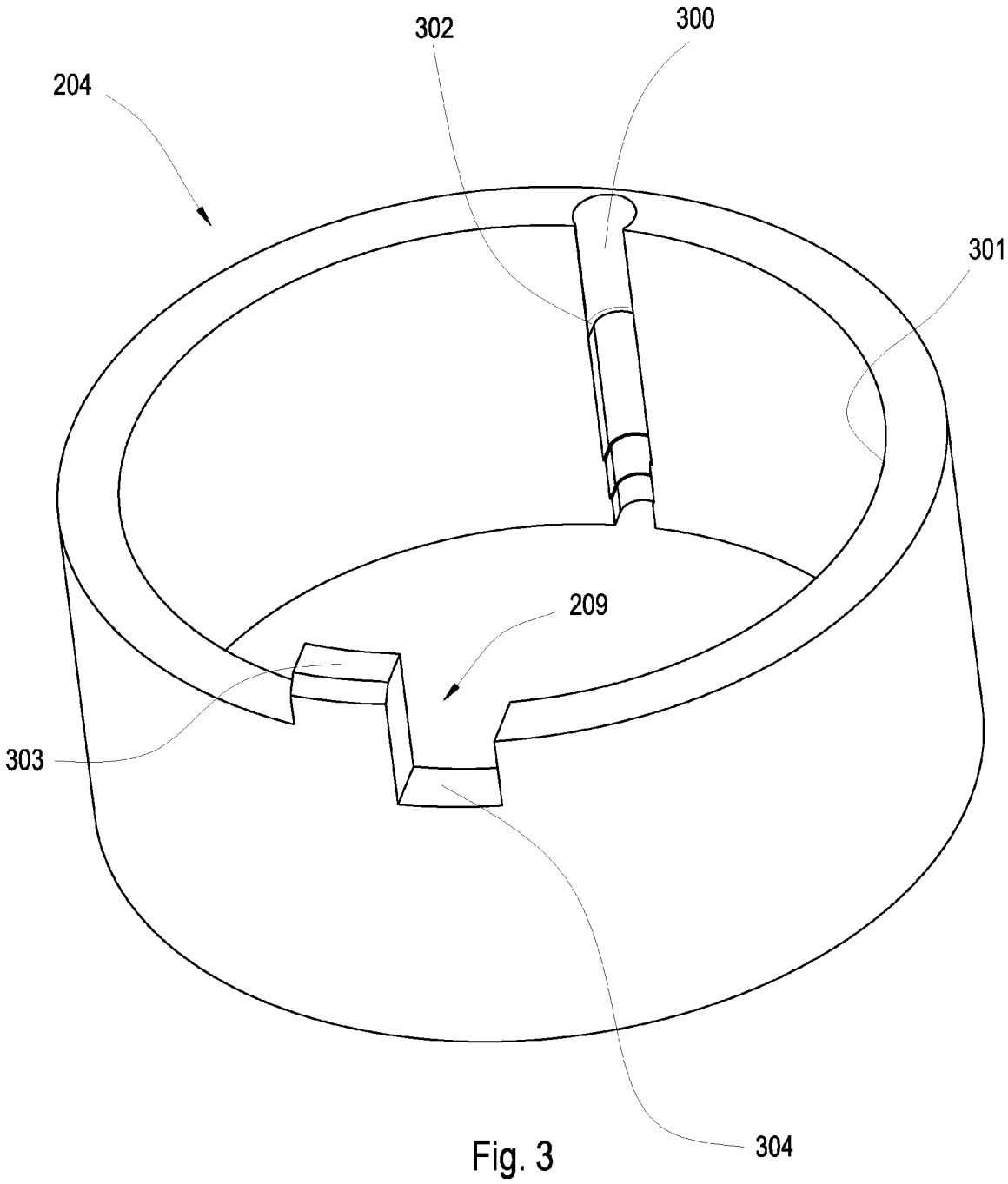
FIG. 3 is a perspective diagram of an embodiment of a collar.

In the preferred embodiment of FIG. 3, the collar 204 comprises a slot 300 formed in the inner diameter 301 of the collar wherein the electrical conductor 200 may be disposed (See FIG. 2). The slot 300 may comprise at least one change 302 in its diameter 301 such that the slot 300 squeezes tightly around a portion of the conductor 200 or matches diameter changes in the conductor 200, preventing the conductor 200 from slipping out of the slot 300 while the drill string component is downhole. The collar 204 may also comprise a protrusion 303 and a recess 304 which together act as a key 209 for interlocking with another protrusion and recess formed in another collar. In some embodiments it is important that the protrusions catch and slide into the recesses, but catching the wall of the protrusion and not the top surface of the protrusion. In order to facilitate the protrusions catching properly, the top surfaces of the protrusions may be angled so that they don't make contact The threadforms in the ends of the downhole components may comprise a helix angle which may correspond to the angle that the protrusions come into contact with one another. Preferably, the top surface angle is steeper than the helix angle of the thread such that the top surfaces may not interlock.

While only one protrusion and recess are shown in the embodiment of FIG. 3, other embodiments include multiple protrusions and recesses. It may be desirable for multiple protrusions to catch at the same time, in such an embodiment it may be desirable some protrusions to be longer than others.

When the collars catch there may need to be some resistance between the collar and the pipe to keep the protrusions next to each other. This resistance may be generated by viscous or frictional drag, inertial resistance, or by a spring mechanism.

Figure 4:
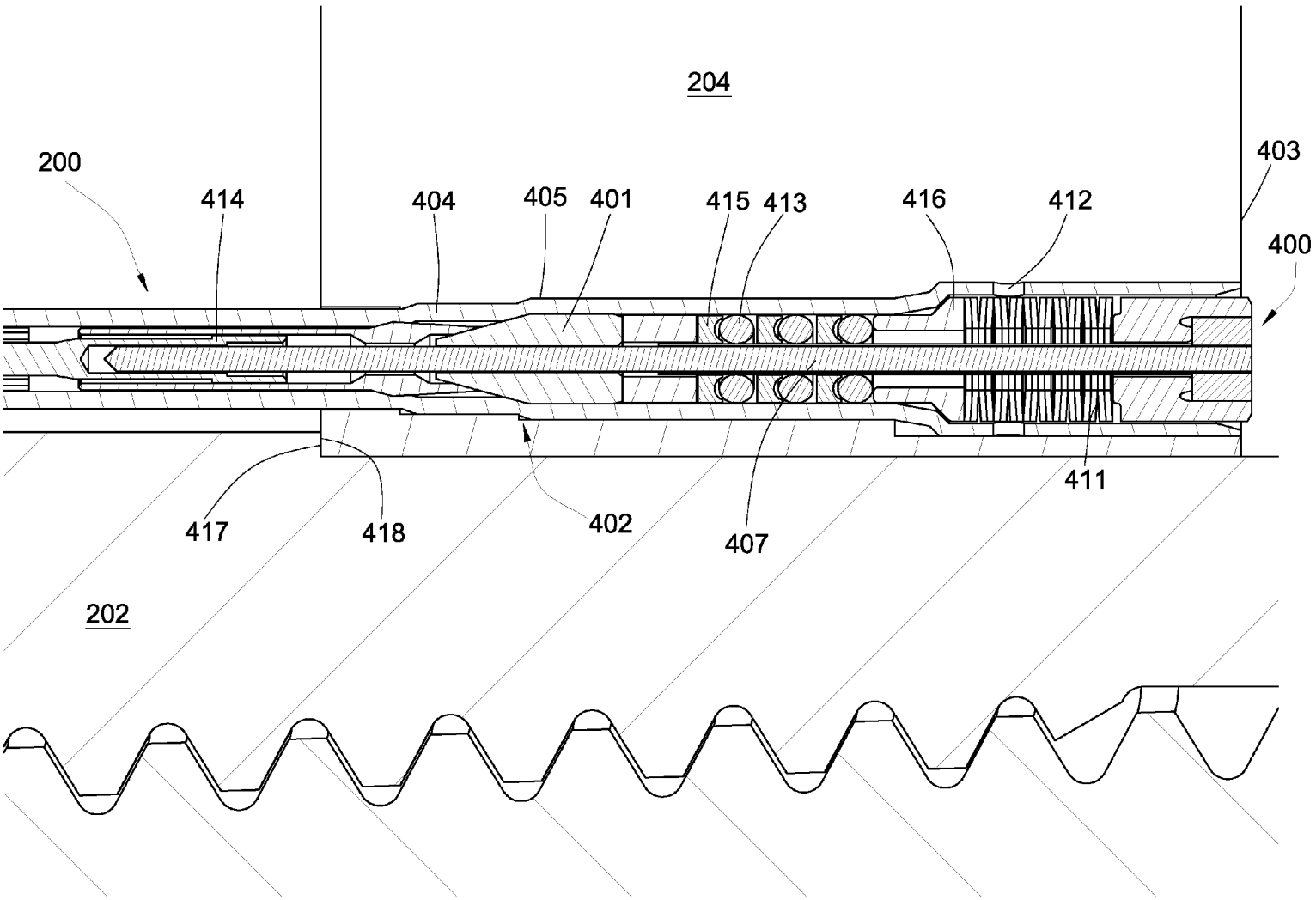
FIG. 4 is a cross-sectional diagram of another embodiment of an electrical conductor.

Referring now to FIG. 4, the electrical conductor 200 may be in tension between first and second collars at opposite ends of the same component 202, and in compression at the interface between collars of different components. Keeping the conductor 200 in tension between the first and second collar of the same component may prevent damage to the conductor 200 within the component 202 while the drill string stretches or compresses downhole. The conductor 200 in tension may also act as a stabilizer for the collars such that the collars fit tightly against the lips 417 even when the collars are not interlocked with collars in other components.

The electrical conductor 200 may be a coaxial cable, copper wire, triaxial cable, twisted pair of wires, or combinations thereof. In the preferred embodiment, the conductor is a coaxial cable. The conductor may comprise a signal transmission element 400 proximate an end 403 of the collar 204, wherein the signal transmission element 400 is shielded from an outer metal conduit 405 by an outer insulating shield 404. The signal transmission element 400 may be an optical element, a magnetic element, an electrically conductive element, an inductive element, or combinations thereof. The signal transmission element may also comprise an electrically conductive center 407 and an electrically insulating periphery 408. The electrically conductive center 407 may be a copper wire or wires and the electrically conductive center 407 may comprise a hard, polished mating surface 409 surrounding the center such as tungsten carbide or other electrically conductive ceramics. The collars may be able to accommodate plug connections, coaxial connections, or any other connection that may need alignment.

The conductor 200 may also comprise a bearing which may allow the conductor to rotate within the slot in the collar such that the conductor 200 doesn't break, twist, or crack while the collar rotates. The bearing may comprise alumina, diamond, steel, silicon nitride, cubic boron nitride, ceramics, carbide, titanium, aluminum, chromium, or combinations thereof.

The conductor 200 may comprise a wedge element 401 placed at a location 402 in the collar where the conductor 200 changes from being in tens ion to being in compression. The wedge element 401 may act as an anchor to the conductor 200. As the signal transmission element 400 is compressed when the collar is interlocked with another collar, the wedge element 401 is also compressed, expanding outward and exerting an outward force on an outer insulating shield 404 of the conductor and preventing the outer shield 404 from collapsing inward. In this manner, the wedge element 401 allows the conductor to be in tension between the first and second collars in the same component. The wedge element 400 may be ferrite or other insulating ceramic.

The signal transmission element 400 may be spring loaded in the electrical conductor 200, with a portion of the signal transmission element extending beyond the end 403 of the collar 204, such that as the electrical conductor 200 comes in contact with a signal transmission element of another component, the extended portion is compressed into the collar, establishing a tight connection. The spring load may be generated by a coiled spring, a Belleville spring 411, a gas spring, a wave spring, an elastomeric material, hoop tension, ramped surfaces, or a combination thereof. The electrical conductor may comprise a venting port 412 in the outer shield 404 proximate the spring load to prevent suction and pressure buildup inside the conductor 200.

The electrical conductor may comprise at least one o-ring 413 adapted to create a seal in order to prevent fluid or particles from disrupting the electrical connection between the signal transmission element 400 and a connector 414 which spans a length of the conductor to a signal transmission element at the other end. The o-ring 413 may be proximate a back-up element 415 made of metal or plastic which is disposed around the electrically conductive center 407 and within the conductor, the purpose of the back-up element 415 is to allow the o-ring 413 to expand within a recess in the back-up element 415 as the o-ring 413 is compressed. A plurality of o-rings and seals, preferably four, may be used to create a tighter seal around the electrically conductive center 407.

Various spacers 416 may be placed within the conductor to separate different elements from interacting directly with each other and to provide greater compression within the conductor. Also, the metal conduit 405 and the outer shield 404 may be swaged down, wherein the diameter of the conductor is reduced to put the elements inside the conductor in compression.

The inner surface 206 of the component 202 may comprise a step change in its diameter, forming a lip 417. The collar 204 may be mounted to the inner surface 206 of the component such that a shoulder 418 of the collar abuts the lip, preventing the collar from going farther into the bore of the component. The collar may also be disposed within a recess formed in the inner surface of the component and may be held in place by tension provided by the electrical conductor.

Figure 5:
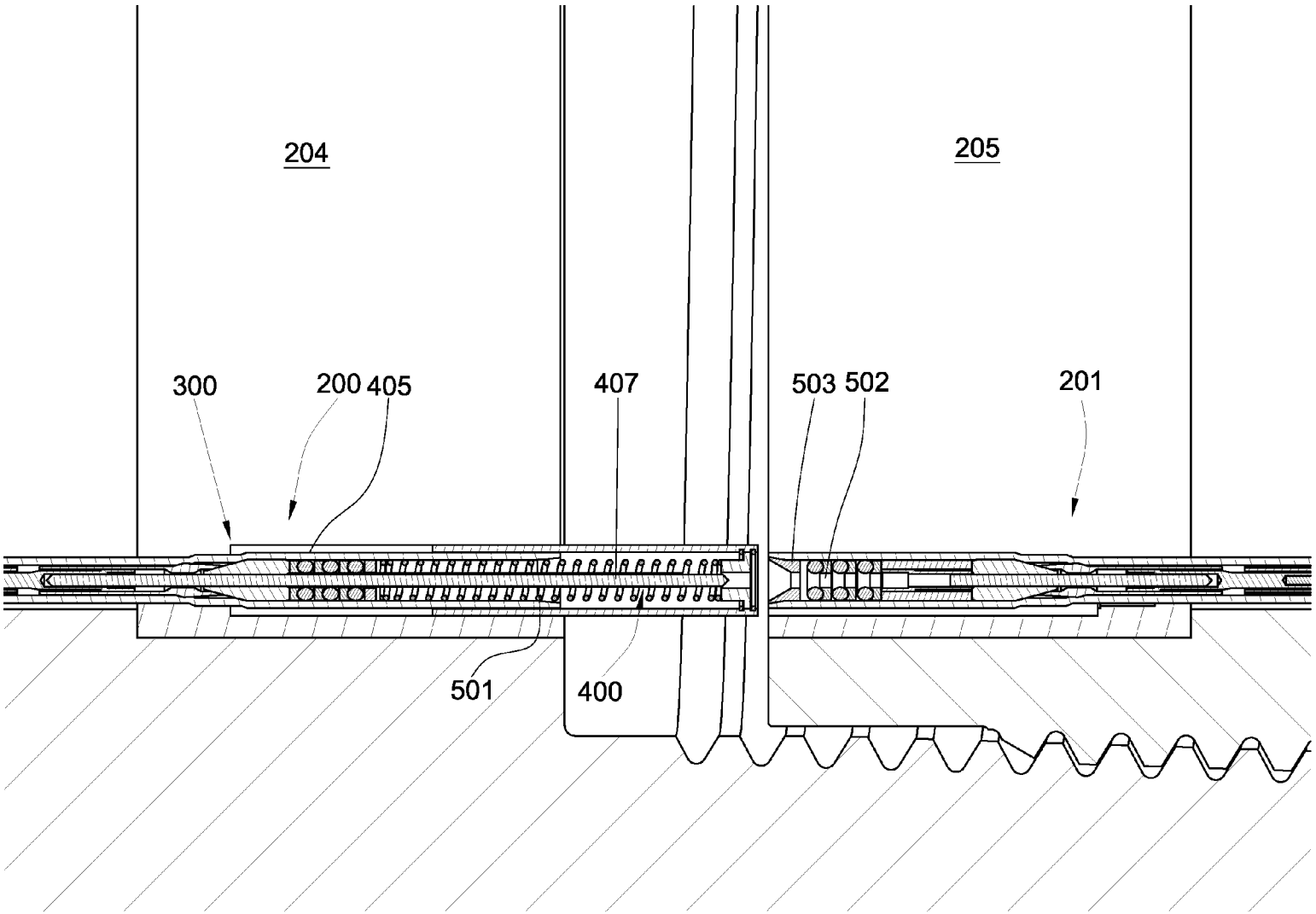
FIG. 5 is a cross-sectional diagram of another embodiment of electrical conductors in two tubular bodies.
Figure 6:
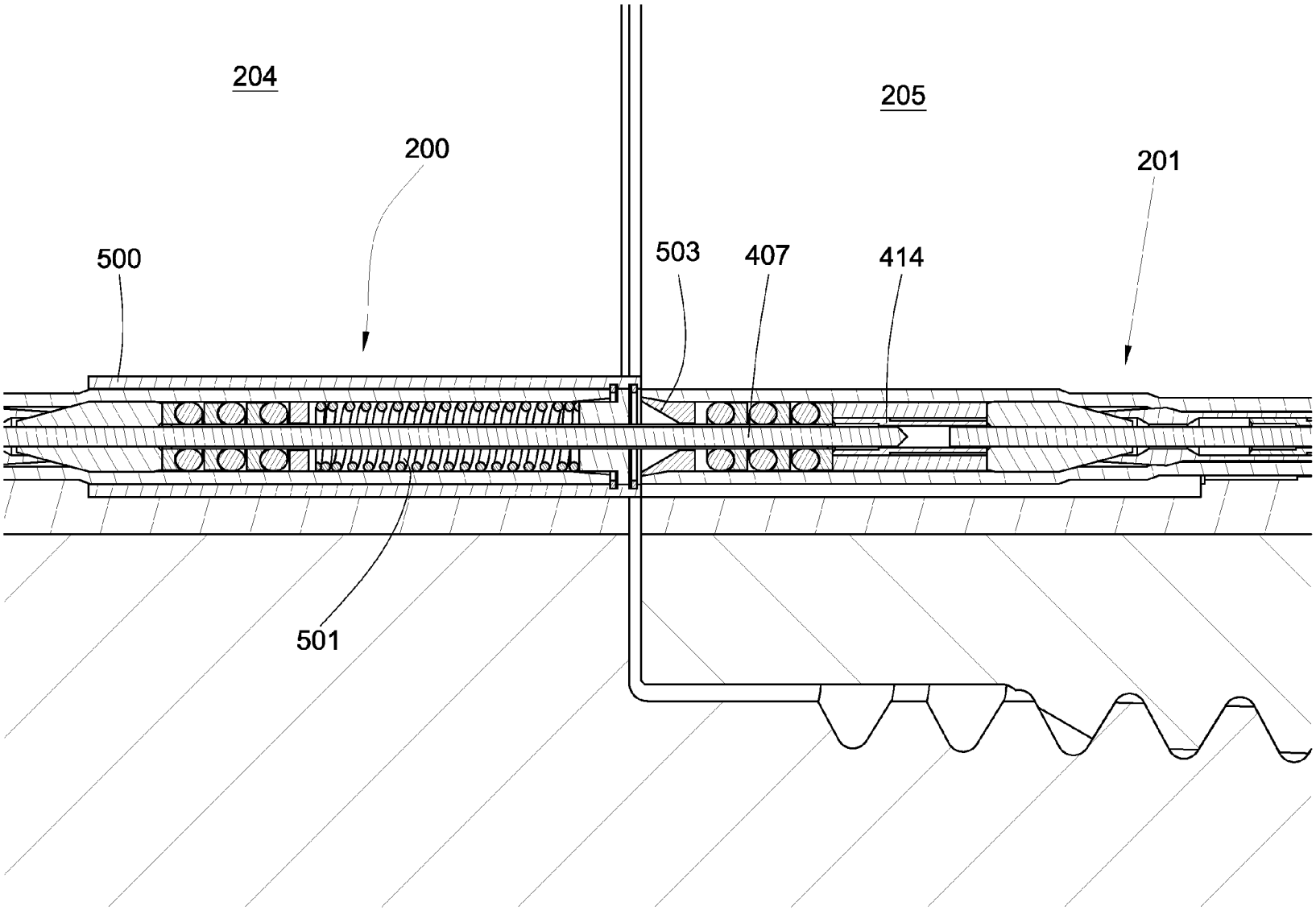
FIG. 6 is a cross-sectional diagram of another embodiment of electrical conductors in two tubular bodies.

Referring now to FIGS. 5 and 6, a first electrical conductor 200 may comprise a sliding sleeve 500 disposed around the outside of the metal conduit 405 and a coiled spring 501 loading the signal transmission element 400, wherein a portion of the signal transmission element is fixed to the sliding sleeve 500. As the conductor 200 comes in contact with a second conductor 201 in an adjacent component after the collars 204, 205 have interlocked, the coiled spring 501 compresses and the sleeve 500 slides back into the slot 300, while the electrically conductive center 207 does not get compressed. When the two components are fully mated, the electrically conductive center 407 of the first conductor is inserted into a core 502 of the second conductor 201 and establishes an electrical connection with a connector 414 in the second conductor 201. The second conductor 201 may comprise a guide 503 to help make a solid connection and to prevent any damage to the electrically conductive center 407.

Figure 7:
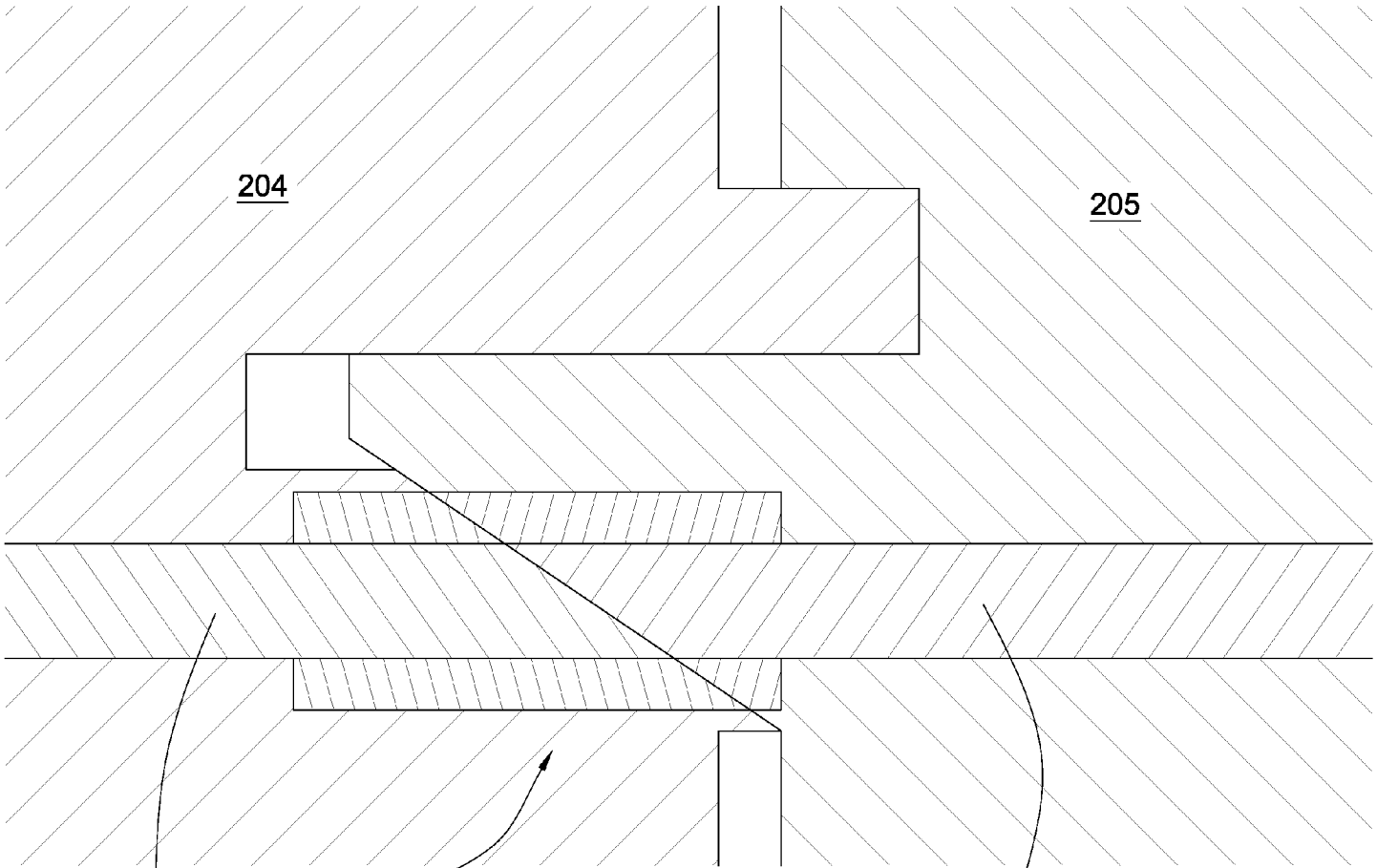
FIG. 7 is a cross-sectional diagram of an embodiment of mated collars.

The electrical conductor 200 may be secured within the key 209 of a collar 204, as in FIG. 7. The keys comprise ramped surfaces 750 so when the keys interlock as the collars 204, 205 come together, the electrical conductors 200, 201 establish an electrical connection. The ramped surfaces 750 may be pushed together providing enough compression to make a good connection.

Figure 8:
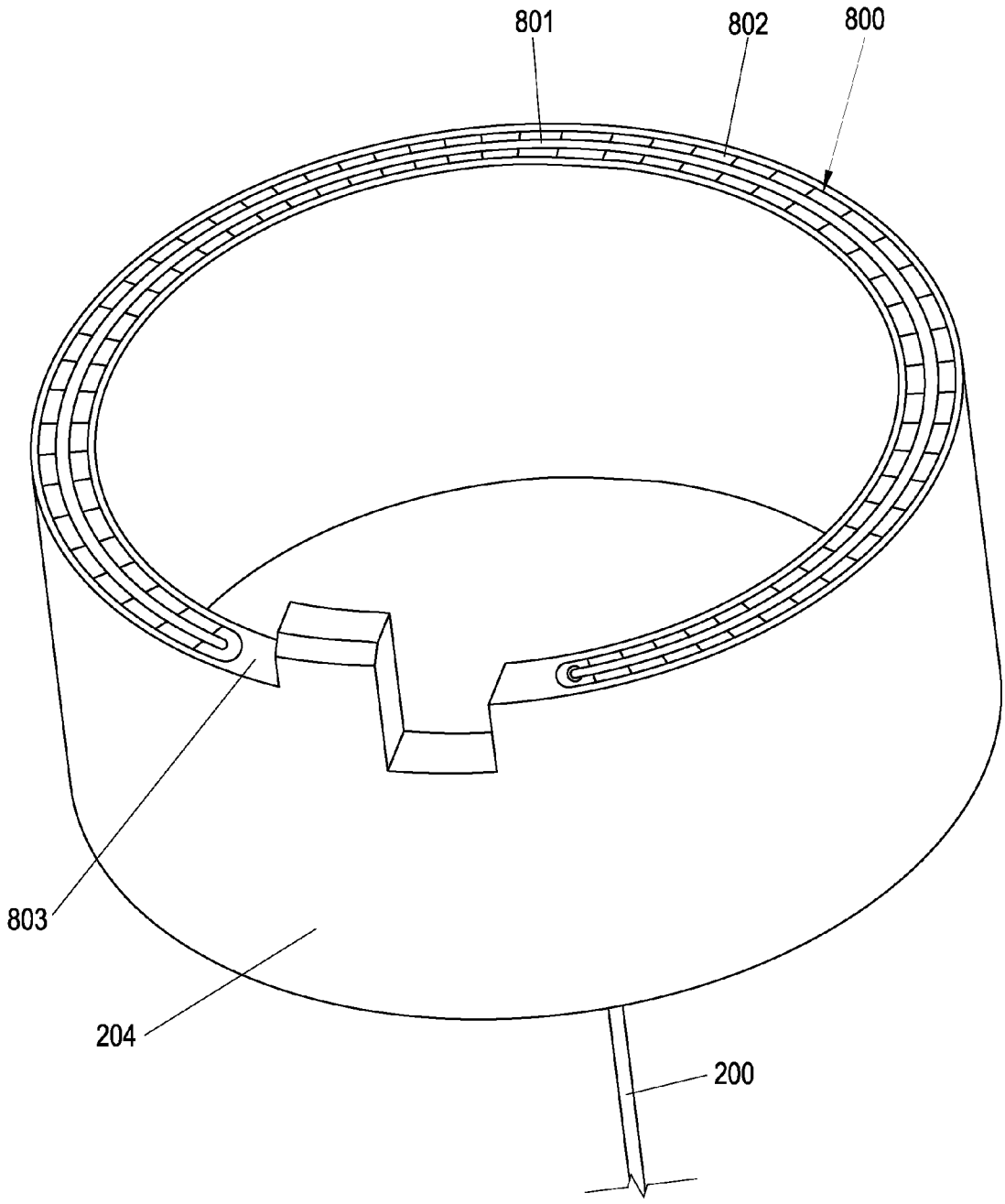
FIG. 8 is a perspective diagram of another embodiment of a collar.

Referring to FIG. 8, the signal transmission element may be an inductive coupler 800 comprising an electrically conductive coil 802 disposed within a magnetically insulating, electrically conductive trough 801 and in electrical communication with an electrical conductor 200. The inductive coupler 800 may be disposed within a shoulder 803 of the collar 204. When the collar 204 interlocks with a second collar from an adjacent component, the inductive coupler 800 may align with a second inductive coupler disposed within the second collar. When an electrical current is sent to the first inductive coupler, a magnetic field is produced which passes through the second inductive coupler, creating an electrical current in the second inductive coupler, which is then transmitted through an electrical conductor in the adjacent component. U.S. Pat. No. 6,670,880 which is herein incorporated by reference for all that it contains, discloses a similar inductive coupler which may be modified to fit the embodiment of FIG. 8.

Figure 9:
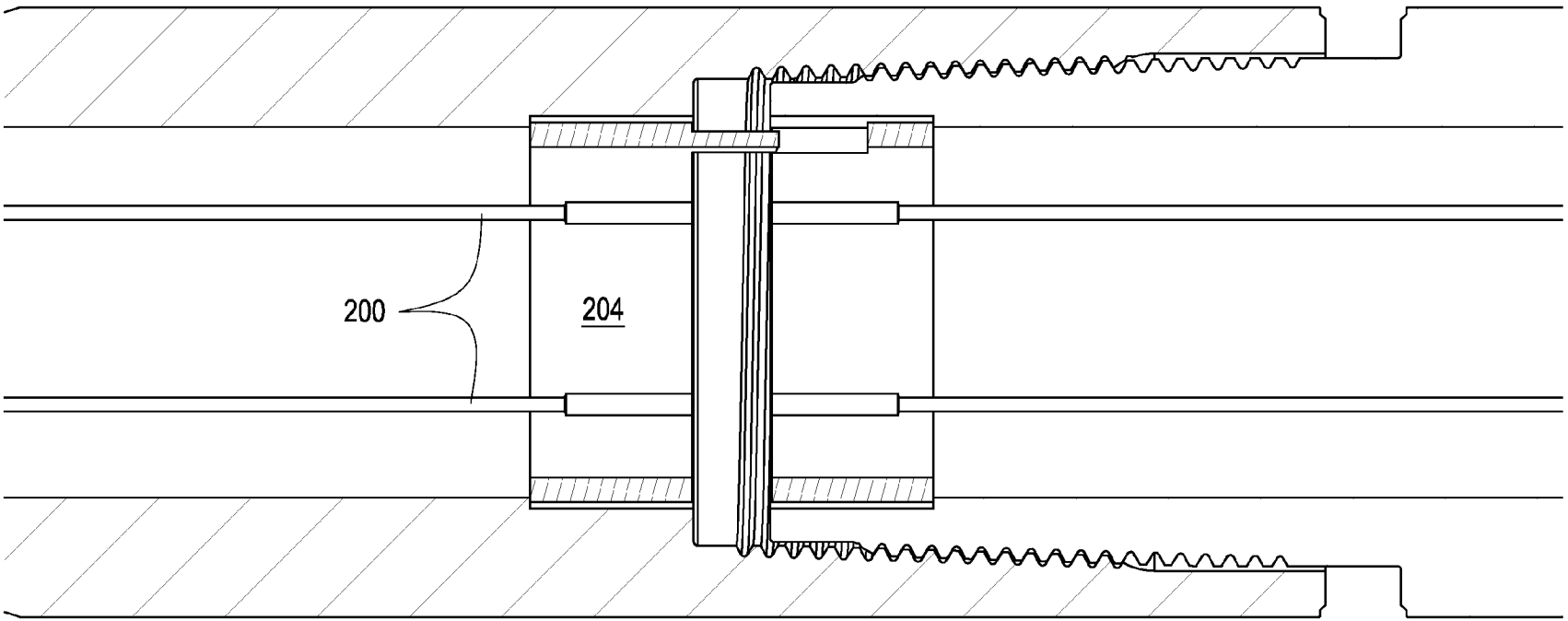
FIG. 9 is a cross-sectional diagram of another embodiment of electrical conductors in two tubular bodies.

The collar 204 may comprise a plurality of electrical conductors 200 disposed within individual slots formed in the inner diameter of the collar, as in the embodiment of FIG. 9. This may allow for different data or power signals to be transmitted along each conductor, which may be advantageous while transmitting signals with lower voltages because of signal noise or signal mixing complexities. The conductors may be spaced evenly apart such that they have a greatest amount of separation between them in order to reduce possible crosstalk between the conductors. In some embodiments, the electrical conductors are shielded such that the cross talk is minimal. A plurality of conductors may also be useful for ease of transmitting signals at different frequencies, if necessary. Another advantage to multiple electrical conductors is an increase in bandwidth.

Figure 10:
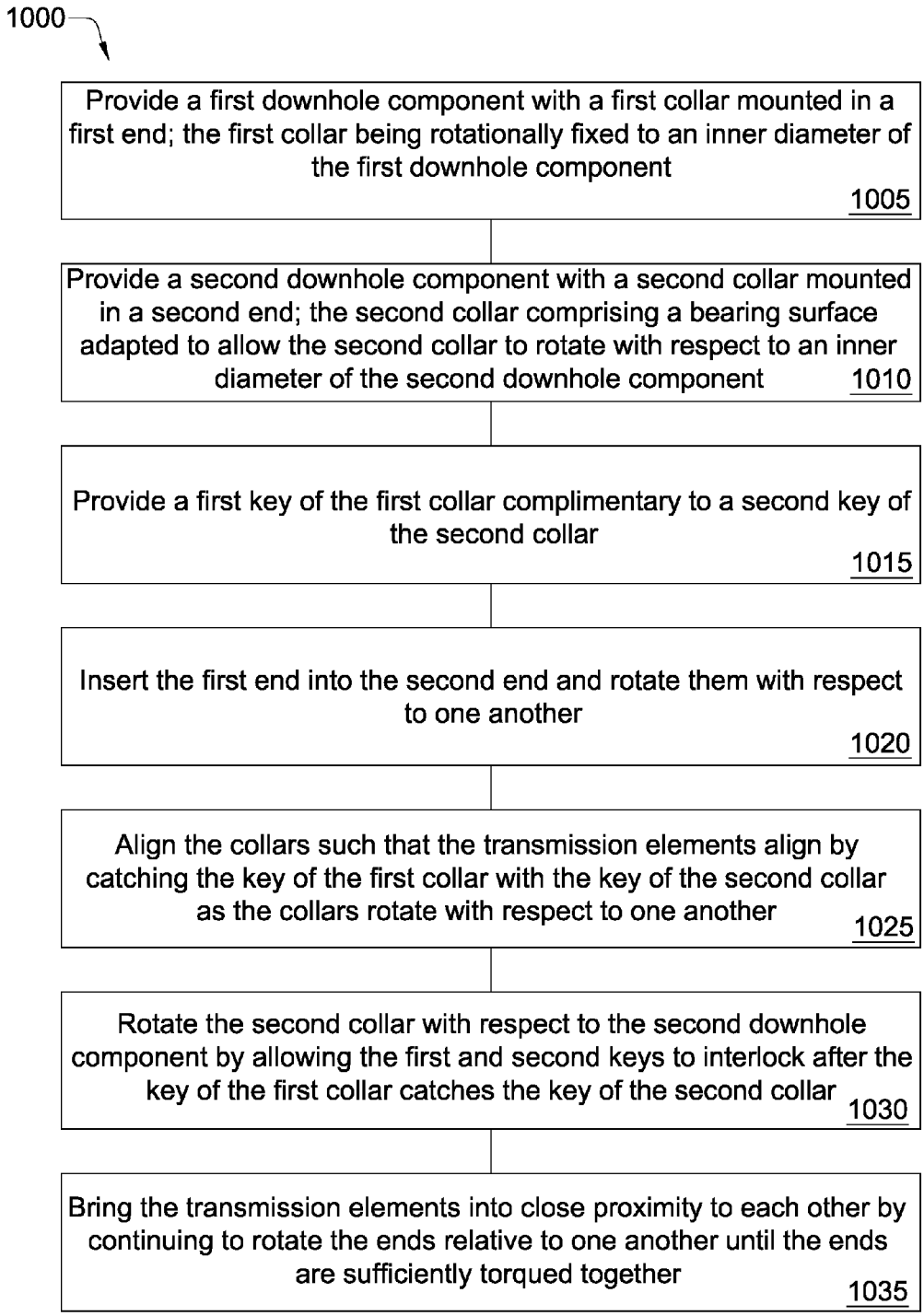
FIG. 10 discloses a method for aligning transmission elements while threadedly joining downhole components.

FIG. 10 is a method 1000 for aligning transmission elements while threadedly joining downhole components, comprising the steps of: providing 1005 a first downhole component with a first collar mounted in a first end; the first collar being rotationally fixed to an inner surface of the first downhole component; providing 1010 a second downhole component with a second collar mounted in a second end; the second collar comprising a bearing surface adapted to allow the second collar to rotate with respect to an inner surface of the second downhole component; providing 1015 a first key of the first collar complimentary to a second key of the second collar; inserting 1020 the first end into the second end and rotating them with respect to one another; aligning 1025 the collars such that the transmission elements align by catching the key of the first collar with the key of the second collar as the collars rotate with respect to one another; rotating 1030 the second collar with respect to the second downhole component by allowing the first and second keys to interlock after the key of the first collar catches the key of the second collar; and bringing 1035 the transmission elements into close proximity to each other by continuing to rotate the ends relative to one another until the ends are sufficiently torqued together.

Whereas the present invention has been described in particular relation to the drawings attached hereto, it should be understood that other and further modifications apart from those shown or suggested herein, may be made within the scope and spirit of the present invention.

What is claimed is:

1. A downhole component of a tool string, comprising:

a tubular body intermediate a first and a second end;

first and second collars mounted to an inner surface of the component at the first and second end respectively;

each collar comprising an electrical conductor secured to the collar;

the first collar comprising a bearing surface adapted to slide with respect to the inner surface of the component;

and the second collar being rotationally fixed to the inner surface of the component;

wherein the electrical conductor is in tension between the first and second collars.

2. The component of claim 1, wherein the downhole component is a drill pipe, drill collar, crossover sub, reamer, jar, hammer, heavy weight pipe, double shouldered pipe, single shouldered pipe, or combinations thereof.

3. The component of claim 1, wherein the bearing surface comprises a polished surface.

4. The component of claim 1, wherein the bearing surface comprises alumina, diamond, steel, silicon nitride, cubic boron nitride, ceramics, carbide, titanium, aluminum, chromium, or combinations thereof.

5. The component of claim 1, wherein the first collar comprises a key complimentary to another key formed in the second collar, wherein the first and second keys are adapted to interlock.

6. The component of claim 1, wherein the second collar is keyed, glued, brazed, or press fit into the second end.

7. The component of claim 1, wherein either collar is disposed within a recess formed in the inner surface and held in place by tension provided by the electrical conductor.

8. The component of claim 1, wherein the electrical conductor is secured within a passageway formed in the collar.

9. The component of claim 8, wherein the electrical conductor is adapted to rotate within the passageway.

10. The component of claim 5, wherein the electrical conductor is secured within one of the keys.

11. The component of claim 1, wherein the electrical conductor comprises a signal transmission element proximate an end of the collar.

12. The component of claim 11, wherein the signal transmission element is spring loaded.

13. The component of claim 12, wherein the spring load is generated by a coiled spring, a Belleville spring, a gas spring, a wave spring, an elastomeric material, hoop tension, ramped surfaces, or a combination thereof.

14. The component of claim 11, wherein the signal transmission element is an optical element, magnetic element, electrically conductive element, inductive element, or combinations thereof.

15. The component of claim 11, wherein the signal transmission element comprises an electrically conductive center and an electrically insulating periphery.

16. The component of claim 11, wherein the electrical conductor comprises a venting port proximate the signal transmission element.

17. The component of claim 1, wherein the electrical conductor is a coaxial cable, copper wire, triaxial cable, twisted pair of wires, or combinations thereof.

18. A method for aligning transmission elements while threadedly joining downhole components, comprising the steps of:

providing a first downhole component with a first collar mounted in a first end;

the first collar being rotationally fixed to an inner surface of the first downhole component;

providing a second downhole component with a second collar mounted in a second end;

the second collar comprising a bearing surface adapted to allow the second collar to rotate with respect to an inner surface of the second downhole component;

providing a first key of the first collar complimentary to a second key of the second collar;

inserting the first end into the second end and rotating them with respect to one another;

aligning the collars such that the transmission elements align by catching the key of the first collar with the key of the second collar as the collars rotate with respect to one another;

rotating the second collar with respect to the second downhole component by allowing the first and second keys to interlock after the key of the first collar catches the key of the second collar;

and bringing the transmission elements into close proximity to each other by continuing to rotate the ends relative to one another until the ends are sufficiently torqued together.

* * * * *